US009488389B2

(12) United States Patent
Conrad et al.

(10) Patent No.: US 9,488,389 B2
(45) Date of Patent: Nov. 8, 2016

(54) CRYOCOOLER REGENERATOR CONTAINING ONE OR MORE CARBON-BASED ANISOTROPIC THERMAL LAYERS

(71) Applicant: Raytheon Company, Waltham, MA (US)

(72) Inventors: Theodore J. Conrad, Redondo Beach, CA (US); Michael J. Ellis, Hawthorne, CA (US); Lowell A. Bellis, Long Beach, CA (US); James R. Chow, San Gabriel, CA (US); Brian R. Schaefer, Huntington Beach, CA (US); Troy T. Matsuoka, Torrance, CA (US)

(73) Assignee: Raytheon Company, Waltham, MA (US)

( * ) Notice: Subject to any disclaimer, the term of this patent is extended or adjusted under 35 U.S.C. 154(b) by 283 days.

(21) Appl. No.: 14/151,408

(22) Filed: Jan. 9, 2014

(65) Prior Publication Data

US 2015/0192329 A1 Jul. 9, 2015

(51) Int. Cl.
*F25B 9/14* (2006.01)
*F25B 9/10* (2006.01)

(52) U.S. Cl.
CPC . *F25B 9/14* (2013.01); *F25B 9/10* (2013.01); *F25B 9/145* (2013.01); *F25B 2309/003* (2013.01); *F25B 2309/1415* (2013.01)

(58) Field of Classification Search
CPC ..... F25B 2309/003; F25B 2309/1415; F25B 9/10; F25B 9/14; F25B 9/145
See application file for complete search history.

(56) References Cited

U.S. PATENT DOCUMENTS 4,259,844 A * 4/1981 Sarcia ..... F25B 9/14 165/10
4,835,973 A * 6/1989 Jones ..... F25B 9/14 62/6
5,613,365 A 3/1997 Mastrup et al.
5,941,079 A 8/1999 Bowman et al.
6,475,935 B1 11/2002 Ishizaki et al.

(Continued)

FOREIGN PATENT DOCUMENTS

CN 202928220 U 5/2013

OTHER PUBLICATIONS

Notification of Transmittal of the International Search Report , dated Jan. 22, 2015, in connection with International Application No. PCT/US2014/064498, 4 pages.

(Continued)

*Primary Examiner* — Emmanuel Duke

(57) ABSTRACT

An apparatus includes a regenerator configured to transfer heat to a fluid and to absorb heat from the fluid as the fluid flows between a warm end and a cold end of a cryocooler. The regenerator includes an anisotropic thermal layer configured to reduce a flow of heat axially along the regenerator and to spread the absorbed heat radially or laterally in a plane of the anisotropic thermal layer. The anisotropic thermal layer includes at least one allotropic form of carbon. The anisotropic thermal layer could have a higher radial or lateral thermal conductivity and a lower axial thermal conductivity. The anisotropic thermal layer could include carbon nanotubes and/or graphene. The regenerator could include multiple anisotropic thermal layers that divide the regenerator into multiple segments, where the anisotropic thermal layers are configured to reduce heat transfer between adjacent segments of the regenerator.

20 Claims, 4 Drawing Sheets

(56) References Cited

U.S. PATENT DOCUMENTS

2006/0225434 A1* 10/2006 Arman ..... F25B 9/145 62/6
2007/0261416 A1* 11/2007 Harvey ..... F25B 9/10 62/6
2011/0186270 A1* 8/2011 Chou ..... F28F 21/02 165/104.28
2011/0289924 A1 12/2011 Pietsch
2014/0069115 A1* 3/2014 Bellis ..... F25B 9/145 62/6

OTHER PUBLICATIONS

Written Opinion of the International Searching Authority, dated Jan. 22, 2015, in connection with International Application No. PCT/US2014/064498, 6 pages.

* cited by examiner

CRYOCOOLER REGENERATOR CONTAINING ONE OR MORE CARBON-BASED ANISOTROPIC THERMAL LAYERS

TECHNICAL FIELD

This disclosure is generally directed to cooling systems. More specifically, this disclosure is directed to a cryocooler regenerator that contains one or more carbon-based anisotropic thermal layers and related system and method.

BACKGROUND

Cryocoolers are often used to cool various components to extremely low temperatures. For example, cryocoolers can be used to cool focal plane arrays in different space and airborne imaging systems. There are various types of cryocoolers having differing designs, such as pulse tube cryocoolers, Stirling cryocoolers, and Gifford-McMahon cryocoolers. These types of cryocoolers typically include a regenerator, which represents a porous material through which fluid (such as liquid or gas) flows back and forth. Heat is stored in and released from the regenerator as the fluid flows back and forth to support the cooling operations of a cryocooler.

A cryocooler typically has a "warm" end and a "cold" end, where the ends represent different portions of the cryocooler that are at different temperatures. A regenerator is often located between the warm end and the cold end of a cryocooler. Any heat flow within a regenerator between the warm and cold ends of a cryocooler reduces the overall cooling capacity and effectiveness of the cryocooler. However, simply using materials with low thermal conductivities in a regenerator may not be possible. Many materials with low thermal conductivities do not possess an adequate volumetric heat capacity needed to form an efficient regenerator for a cryocooler.

SUMMARY

This disclosure provides a cryocooler regenerator that contains one or more carbon-based anisotropic thermal layers and a related system and method.

In a first embodiment, an apparatus includes a regenerator configured to transfer heat to a fluid and to absorb heat from the fluid as the fluid flows between a warm end and a cold end of a cryocooler. The regenerator includes an anisotropic thermal layer configured to reduce a flow of heat axially along the regenerator and to spread the absorbed heat radially or laterally in a plane of the anisotropic thermal layer. The anisotropic thermal layer includes at least one allotropic form of carbon.

In a second embodiment, a system includes a cryocooler having a warm end and a cold end. The cryocooler includes a compressor configured to move a fluid between the warm end and the cold end of the cryocooler and a regenerator configured to contact the fluid. The regenerator is also configured to transfer heat to the fluid and to absorb heat from the fluid as the fluid flows between the warm end and the cold end of the cryocooler. The regenerator includes an anisotropic thermal layer configured to reduce a flow of heat axially along the regenerator and to spread the absorbed heat radially or laterally in a plane of the anisotropic thermal layer. The anisotropic thermal layer includes at least one allotropic form of carbon.

In a third embodiment, a method includes creating a flow of fluid back and forth between a warm end and a cold end of a cryocooler. The method also includes transferring heat to the fluid and absorbing heat from the fluid using a regenerator as the fluid flows between the warm end and the cold end of the cryocooler. The method further includes reducing a flow of heat axially along the regenerator using an anisotropic thermal layer within the regenerator. The anisotropic thermal layer also spreads the absorbed heat radially or laterally in a plane of the anisotropic thermal layer. The anisotropic thermal layer includes at least one allotropic form of carbon.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 5, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1:
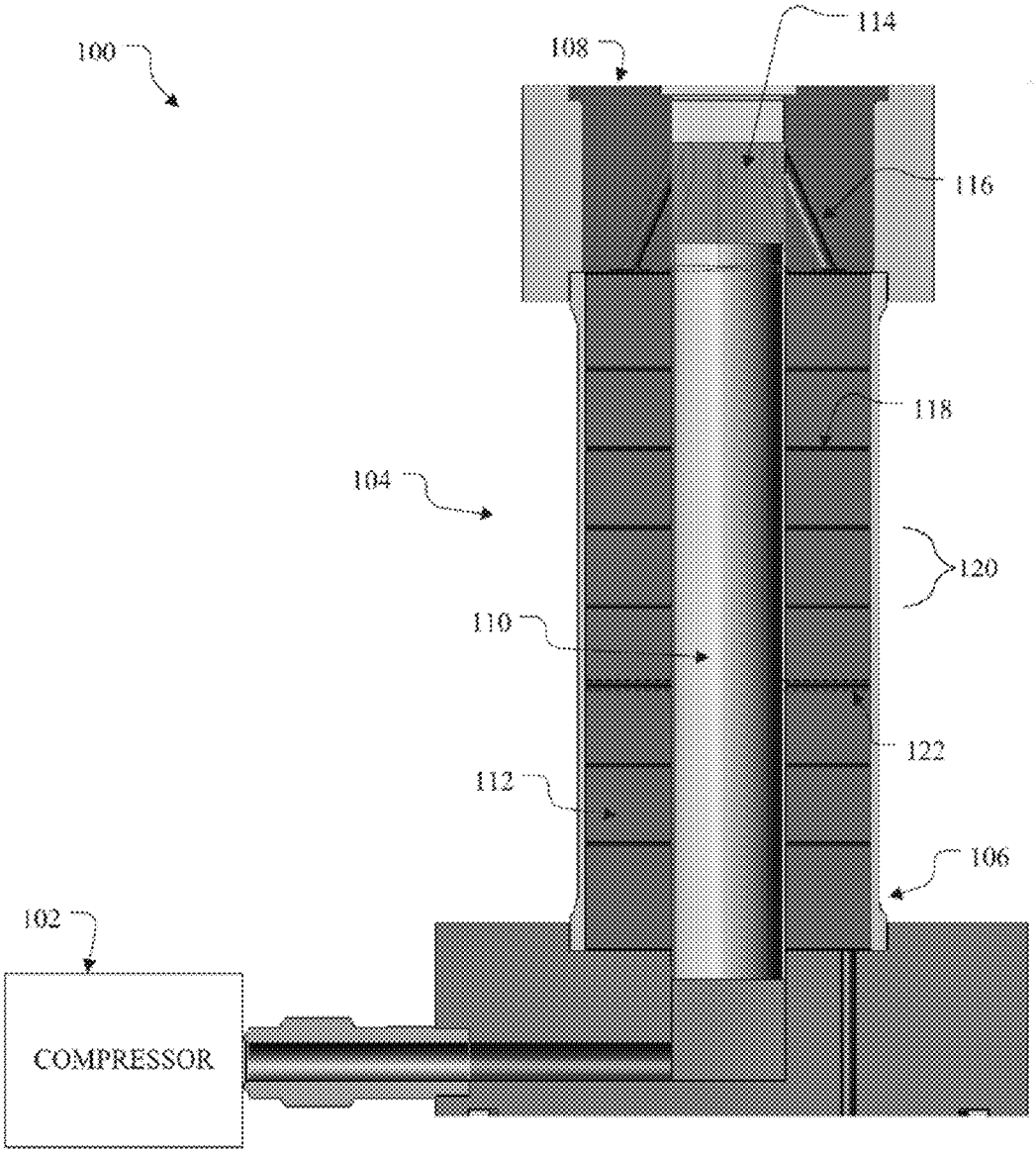
FIG. 1 illustrates a first example cryocooler having a regenerator that contains one or more carbon-based anisotropic thermal layers in accordance with this disclosure.

FIG. 1 illustrates a first example cryocooler 100 having a regenerator that contains one or more carbon-based anisotropic thermal layers in accordance with this disclosure. More specifically, FIG. 1 illustrates a pulse tube cryocooler having a regenerator that contains one or more carbon-based anisotropic thermal layers.

As shown in FIG. 1, the cryocooler 100 includes a compressor 102 and an expander assembly 104. The compressor 102 creates a flow of fluid within the expander assembly 104. For example, the compressor 102 could include a piston that strokes back and forth during each compression cycle, where multiple compression cycles occur at a specified drive frequency. The piston can therefore push the fluid into the expander assembly 104 and draw the fluid out of the expander assembly 104 during operation of the compressor 102. The compressor 102 includes any suitable structure for moving at least one gas or other fluid(s) in a cooling system.

Fluid is pushed into and pulled out of the expander assembly 104 by the compressor 102. This back and forth motion of the fluid, along with controlled expansion and contraction of the fluid, creates cooling in the expander assembly 104. In this example, the expander assembly 104 has a warm end 106 and a cold end 108. As the names imply, the warm end 106 of the expander assembly 104 is at a higher temperature than the cold end 108 of the expander assembly 104. The cold end 108 of the expander assembly 104 could reach any suitably low temperature, such as down to about 4 Kelvin or even lower depending on the design. The cold end 108 of the expander assembly 104 can therefore, for example, be thermally coupled to a device or system to be cooled.

The expander assembly 104 includes a pulse tube 110 surrounded by a regenerator 112. The pulse tube 110 represents a passageway through which the fluid can move or pulse back and forth. The regenerator 112 represents a structure that contacts the fluid and exchanges heat with the fluid. For example, when the fluid passes from the warm end 106 to the cold end 108 of the expander assembly 104, heat from the fluid can be absorbed by the regenerator 112. When the fluid passes from the cold end 108 to the warm end 106 of the expander assembly 104, heat from the regenerator 112 can be absorbed by the fluid.

The pulse tube 110 includes any suitable structure for holding a fluid that pulses or otherwise moves back and forth during multiple cycles. The pulse tube 110 could be formed from any suitable material(s) and have any suitable size, shape, and dimensions. The pulse tube 110 could also be fabricated in any suitable manner.

The regenerator 112 includes any suitable structure for transferring heat to and from a fluid in a cryocooler. The regenerator 112 typically includes a porous structure, such as a matrix of porous material or a metallic mesh. A hole can be bored in or otherwise formed through the porous structure for the pulse tube 110. In some embodiments, the regenerator 112 could be formed from multiple stacked elements, where each element is porous. Examples of porous materials that could be used include glass fibers, metal foams, stacked metal screens (such as stainless steel screens), packed spheres (such as stainless steel, lead, or rare earth spheres), etched foils, and photo-etched disks. In the example shown in FIG. 1, the pulse tube 110 and the regenerator 112 are concentric, although this is not required.

The cold end 108 of the expander assembly 104 includes a heat exchanger 114 and coupling channels 116. The heat exchanger 114 generally operates to remove heat at the cold end 108 of the expander assembly 104. The coupling channels 116 fluidly couple the heat exchanger 114 and the regenerator 112.

As noted above, any heat flow within a regenerator between the warm end and the cold end of a cryocooler reduces the overall cooling capacity and effectiveness of the cryocooler. The regenerator is often an important component for determining the overall performance of a cryocooler as it affects the capacity, efficiency, and attainable temperature of the cryocooler. Ideally, a regenerator has good solid/fluid heat transfer characteristics, a low pressure drop, and low end-to-end thermal conduction. However, conventional regenerators often have an end-to-end thermal conduction that is higher than desired.

To help reduce end-to-end thermal conduction in the regenerator 112, the regenerator 112 includes one or more anisotropic thermal layers 118. Each anisotropic thermal layer 118 represents a film or other thin layer of material that allows fluid to pass through the regenerator 112 between the warm end 106 and the cold end 108 of the expander assembly 104. Each anisotropic thermal layer 118 is also configured to substantially block heat from traveling in an axial or out-of-plane direction (up or down in FIG. 1) along the regenerator 112. Rather, each anisotropic thermal layer 118 allows heat to travel radially or laterally within the plane of the layer 118 (right or left in FIG. 1). As a result, each anisotropic thermal layer 118 can be said to have a higher thermal conductivity in an "in plane" direction and a substantially lower thermal conductivity in an "out of plane" direction. In this document, the term "axial" refers to a direction substantially parallel to an axis of a regenerator along a longer dimension of the regenerator. The terms "radial" and "lateral" refer to a direction substantially perpendicular to the axial direction.

Each anisotropic thermal layer 118 includes at least one allotropic form of carbon, such as carbon nanotubes or graphene. Carbon nanotubes and graphene are both allotropes of carbon, meaning they are formed using carbon atoms in particular arrangements. In the case of graphene, graphene is a one-atom thick layer of carbon atoms arranged in a regular hexagonal pattern. In the case of carbon nanotubes, carbon atoms are arranged to form three-dimensional cylindrical nanostructures, where the walls of the cylinders are formed from graphene. In these embodiments, carbon nanotubes or graphene can be used in sheet or paper form, meaning the carbon nanotubes or graphene are condensed in a higher-order sheet assembly resembling carbon nanotubes or graphene paper (i.e. arranged in a generally flat planar structure of a thickness in microns).

Carbon nanotubes have an anisotropic thermal conductivity that is orders of magnitude lower across the tubes than along the tubes. Similarly, graphene has an anisotropic thermal conductivity that is orders of magnitude lower normal to the plane of the graphene than within the plane of the graphene. Because of these properties, the addition of carbon nanotubes or graphene to the regenerator 112 in one or more anisotropic thermal layers 118 can significantly reduce the axial thermal conductivity of the regenerator 112. Effectively, the one or more anisotropic thermal layers 118 can divide the regenerator 112 into multiple segments 120. There may still be some heat transfer axially within each segment 120 of the regenerator 112. However, the anisotropic thermal layer(s) 118 can help to substantially reduce heat transfer between adjacent segments 120 of the regenerator 112, which can significantly reduce heat transfer axially along the entire regenerator 112 while increasing thermal spreading in the plane of each anisotropic thermal layer 118.

Each anisotropic thermal layer 118 may lack adequate structural strength or heat capacity on its own for use within the regenerator 112. As a result, one or more support layers 122 could be used in the regenerator 112 to retain or otherwise support an anisotropic thermal layer 118 or alter the heat capacity of an anisotropic thermal layer 118. Any suitable support layers 122 could be used to help maintain the structural stability or increase the heat capacity of an anisotropic thermal layer 118. In some embodiments, the support layers 122 could include metallic screens or meshes, such as those made of stainless steel or other material(s). While support layers 122 for one anisotropic thermal layer 118 are shown in FIG. 1, any number of anisotropic thermal layers 118 could have associated support layers 122.

Figure 2A:
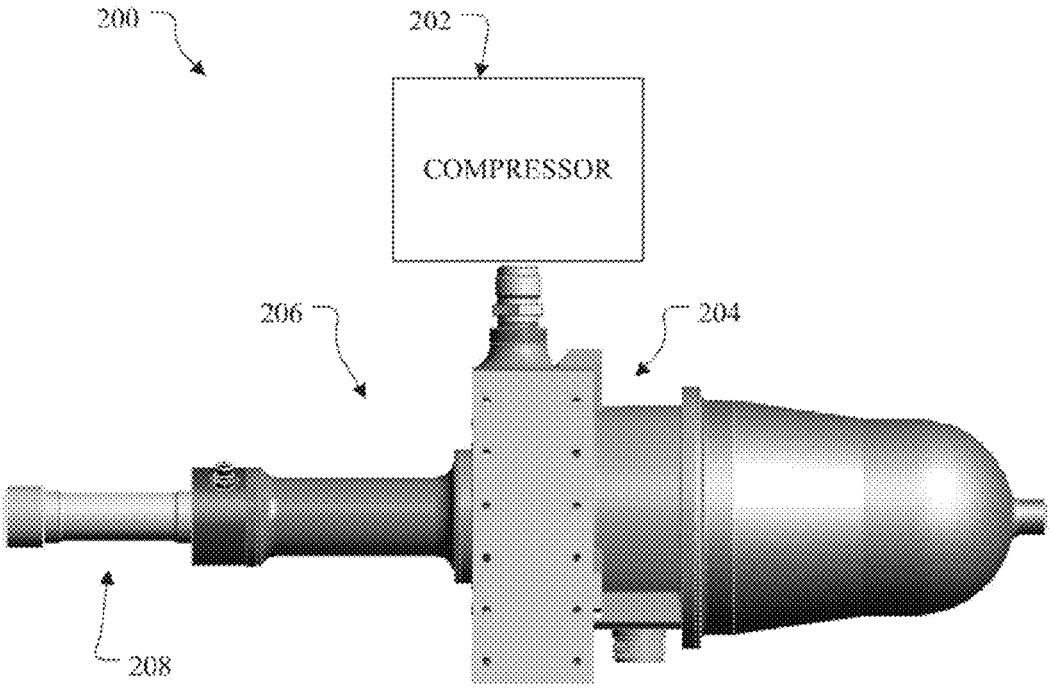
FIGS. 2A and 2B illustrate a second example cryocooler having a regenerator that contains one or more carbon-based anisotropic thermal layers in accordance with this disclosure.
Figure 2B:
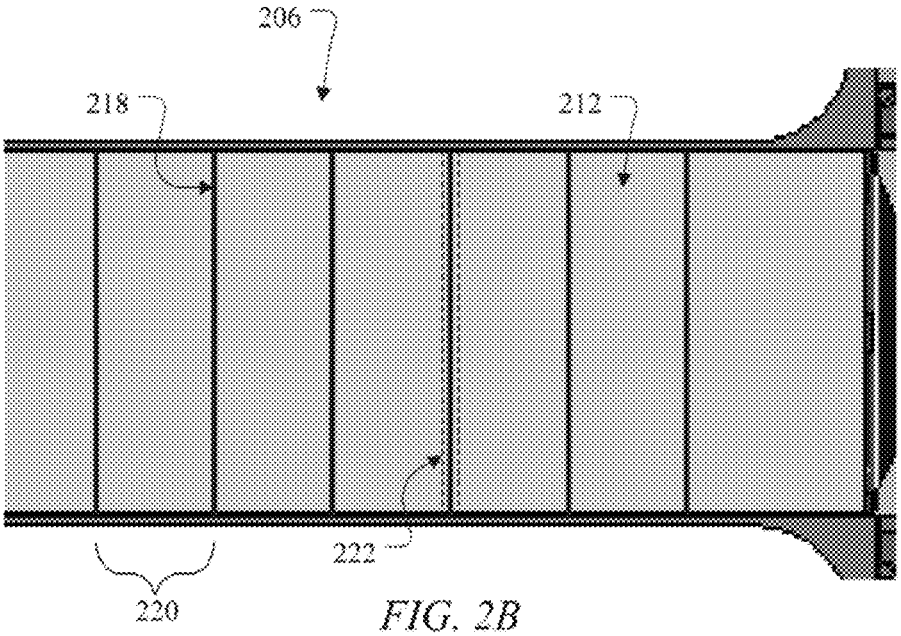

FIGS. 2A and 2B illustrate a second example cryocooler 200 having a regenerator that contains one or more carbon-based anisotropic thermal layers in accordance with this disclosure. More specifically, FIGS. 2A and 2B illustrate a two-stage Stirling cryocooler having a regenerator that contains one or more carbon-based anisotropic thermal layers.

As shown in FIGS. 2A and 2B, a compressor 202 is fluidly coupled to an expander assembly 204 and causes fluid to move back and forth within the expander assembly 204. Any suitable compressor 202 could be used in the cryocooler 200. The expander assembly 204 represents part of a first stage 206 of the two-stage Stirling cooling system. A second stage 208 of the Stirling cooling system includes a pulse tube.

Part of the first stage 206 is shown in greater detail in FIG. 2B. As shown in FIG. 2B, the first stage 206 includes a regenerator 212 through which the fluid traveling within the first and second stages 206-208 passes. Once again, the regenerator 212 represents a structure that contacts the fluid and exchanges heat with the fluid. For example, when the fluid passes right to left through the regenerator 212 in FIG. 2B, heat from the fluid can be absorbed by the regenerator 212. When the fluid passes left to right through the regenerator 212 in FIG. 2B, heat from the regenerator 212 can be absorbed by the fluid.

The regenerator 212 includes one or more anisotropic thermal layers 218 that divide the regenerator 212 into multiple segments 220. Each anisotropic thermal layer 218 represents a film or other thin layer that includes at least one allotropic form of carbon, such as carbon nanotubes or graphene. Also, one or more support layers 222 could be used to provide structural support or additional heat capacity to one or more anisotropic thermal layers 218. These components 218-222 could be the same as or similar to the corresponding components 118-222 in FIG. 1, although the components 218-222 have a different shape than in FIG. 1. Note that any number of anisotropic thermal layers 218 could be used. Also note that while support layers 222 for one thermal layer 218 are shown in FIG. 2B, any number of thermal layers 218 could have associated support layers 222.

The porosity of the thermal layers 118, 218 could be controlled or modified in order to achieve desired heat transfer characteristics, fluid flow characteristics, or other characteristics in the regenerators 112, 212. For example, after a sheet of carbon nanotubes or graphene is fabricated, the sheet could undergo one or more post-production processing operations to create pores of one or more desired sizes in the sheet. This could be accomplished in any suitable manner, such as by using one or more lasers. In some embodiments, the film porosity can be controlled so as to be high enough to not substantially impede the flow of fluid in the regenerators 112, 212 and to not give rise to a substantial pressure drop within the regenerators 112, 212.

The use of at least one carbon allotrope in a regenerator 112, 212 can have various advantages depending on the implementation. For example, the anisotropic thermal conductivity of carbon nanotubes or graphene helps to spread heat radially/laterally through a regenerator 112, 212 while reducing axial thermal conductivity, which can improve the efficiency of a cryocooler. Thermodynamic modeling of a regenerator containing carbon nanotube sheets layered with stainless steel screens show a performance improvement between 16%-37% depending on the percent volume of the regenerator occupied by the carbon nanotubes (with a maximum performance improvement at around 70% by volume of carbon nanotubes). However, this modeling is associated with a specific design and does not limit this disclosure to any particular performance improvement or regenerator design.

Moreover, sheets of carbon nanotubes or graphene can be fabricated in very thin layers with a range of densities. As a result, the sheets may occupy very little space in a regenerator 112, 212 and thus have little impact on the volumetric heat capacity of the regenerator. The sheets can also serve as a platform for specialty cryomaterials that can be used to impart optimal volumetric heat capacity. Further, the desirable material properties of carbon nanotubes and graphene apply across a wide range of cryogenic temperatures. In combination with a controllable pore size, this may allow the carbon nanotubes or graphene to be combined with most or all other regenerator materials known or to be developed in order to produce a more optimal regenerator for a given temperature and application. In addition, regenerators that use carbon nanotubes or graphene could be fabricated as a drop-in replacement for regenerators in existing cryocoolers, allowing both new cryocoolers to be fabricated and existing cryocoolers to be retrofitted with regenerators that contain carbon nanotubes or graphene.

Although FIGS. 1 through 2B illustrates examples of cryocoolers 100, 200 having regenerators 112, 212 that contain one or more carbon-based anisotropic thermal layers 118, 218, various changes may be made to FIGS. 1 through 2B. For example, each regenerator 112, 212 could include any number of anisotropic thermal layers 118, 218. Also, FIGS. 1 through 2B represent examples of cryocoolers that could include regenerators that contain one or more carbon-based anisotropic thermal layers. Such regenerators could be used in other types of cryocoolers, such as in a single-stage Stirling cryocooler or a Gifford-McMahon cryocooler. In general, any single-stage or multi-stage cryocooler that includes a regenerator could have one or more carbon-based anisotropic thermal layers within the regenerator.

Figure 3:
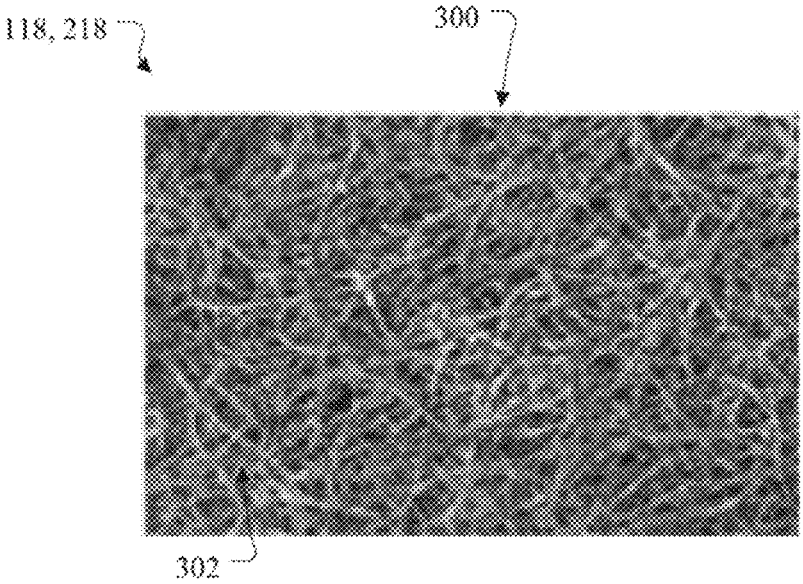
FIGS. 3 and 4 illustrate example carbon-based anisotropic thermal layers for a cryocooler regenerator in accordance with this disclosure.
Figure 4:
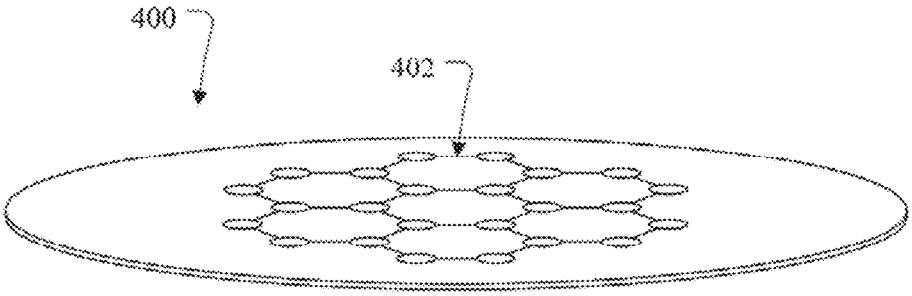

FIGS. 3 and 4 illustrate example carbon-based anisotropic thermal layers for a cryocooler regenerator in accordance with this disclosure. More specifically, FIGS. 3 and 4 illustrate example anisotropic thermal layers 118, 218 that could be used in the regenerators 112, 212 of FIGS. 1 through 2B or in any other suitable cryocoolers.

FIG. 3 shows a close-up view of a portion of a sheet 300 of carbon nanotubes 302. As can be seen in FIG. 3, the carbon nanotubes 302 are generally planar and travel substantially laterally within the sheet 300. The carbon nanotubes 302 here travel random paths within the sheet 300, although more regular paths could be imparted in a sheet 300.

This arrangement of carbon nanotubes 302 allows fluid to flow through the sheet 300 and contact the carbon nanotubes 302. Heat transfer can then occur between the fluid and the carbon nanotubes 302. The porosity of the sheet 300 can be controlled based on, for example, the quantity and size(s) of the carbon nanotubes 302 within the sheet 300, as well as any post-production processing operations (such as laser etching through the sheet 300). Also, the overall size and shape of the sheet 300 can be based on various factors, such as the desired volumetric heat capacity and shape of the regenerator 112, 212.

Heat transport generally occurs along the carbon nanotubes 302. As can be seen in FIG. 3, the carbon nanotubes 302 generally travel laterally (side to side) within the sheet 300. As a result, a significant portion of the heat transported through the carbon nanotubes 302 is transported laterally within the sheet 300. To the small extent the carbon nanotubes 302 travel axially (top to bottom) within the sheet 300, this results in a significantly smaller amount of heat transport axially within the sheet 300. Because of this, the sheet 300 can function effectively as an insulative layer and can help to reduce heat transfer axially along a regenerator 112, 212. Note that it is also possible to dope or co-deposit the carbon nanotubes 302 with one or more other materials to adjust the volumetric thermal capacity of the regenerator 112, 212.

In FIG. 4, an anisotropic thermal layer 118, 218 is formed using a sheet 400 of graphene (sometimes referred to as "graphene paper"). As can be seen in FIG. 4, the sheet 400 represents a thin structure formed using a condensed hexagonal matrix 402 of carbon atoms. Pores can be formed through the sheet 400 of graphene in any suitable manner, such as via laser etching. This allows fluid to flow through the sheet 400 and contact the graphene, and heat transfer can then occur between the fluid and the graphene. Note that while shown as being in the shape of a disc, the overall size and shape of the sheet 400 can be based on various factors, such as the desired volumetric heat capacity and shape of the regenerator 112, 212.

Once again, heat transport generally occurs laterally within the sheet 400, mainly along the matrix 402 of carbon atoms. Since the matrix 402 is arranged laterally (side to side) within the sheet 400, a significant portion of the heat transported through the matrix 402 is transported laterally within the sheet 400. To the small extent the matrix 402 travels axially (top to bottom) within the sheet 400, this results in a significantly smaller amount of heat transport axially within the sheet 400. Because of this, the sheet 400 can function effectively as an insulative layer that can help to reduce heat transfer axially along a regenerator 112, 212.

Although FIGS. 3 and 4 illustrate examples of carbon-based anisotropic thermal layers for a cryocooler regenerator, various changes may be made to FIGS. 3 and 4. For example, each anisotropic thermal layer 118, 218 could have any suitable form factor, such as a rectangular sheet, circular disc, toroidal disc, or other regular or irregular shape. Also, an anisotropic thermal layer 118, 218 need not occupy a small space within a regenerator and could instead occupy a much larger space within a regenerator.

Figure 5:
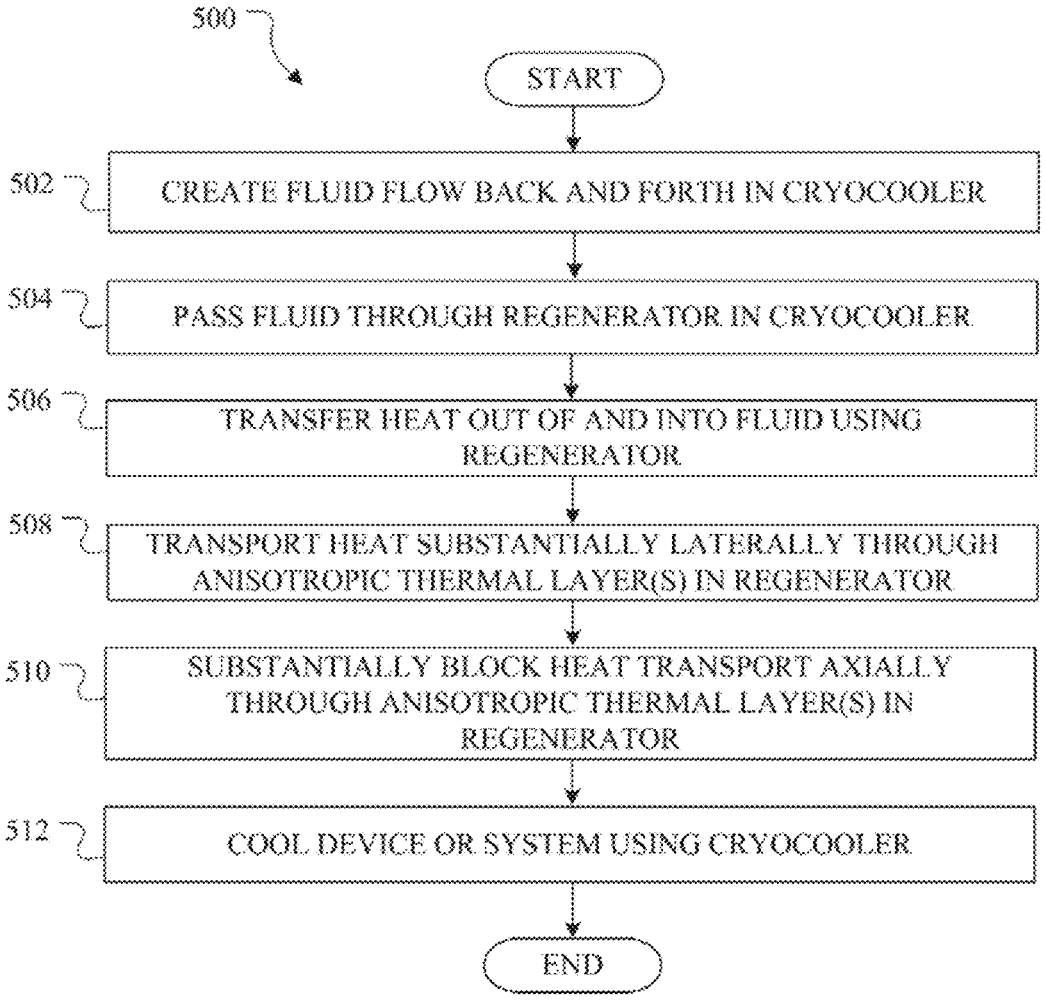
FIG. 5 illustrates an example method for cooling a structure using a cryocooler having a regenerator that contains one or more carbon-based anisotropic thermal layers in accordance with this disclosure.

FIG. 5 illustrates an example method 500 for cooling a structure using a cryocooler having a regenerator that contains one or more carbon-based anisotropic thermal layers in accordance with this disclosure. For ease of explanation, the method 500 is described with respect to the cryocoolers 100, 200 in FIGS. 1 through 2B operating with the regenerators 112, 212 containing the anisotropic thermal layers 118, 218. However, the method 500 could be used with any single-stage or multi-stage cryocooler that includes a regenerator having one or more carbon-based anisotropic thermal layers.

As shown in FIG. 5, a flow of fluid back and forth is created within a cryocooler at step 502. This could include, for example, the compressor 102 operating to create a back-and-forth fluid flow in the expander assembly 104 of the cryocooler 100. This could also include the compressor 202 operating to create a back-and-forth fluid flow in the multiple stages 206-208 of the cryocooler 200.

The fluid flows through a regenerator in the cryocooler at step 504. This could include, for example, the fluid flowing through pores or other passages through the regenerator 112, 212. The regenerator here includes at least one anisotropic thermal layer 118, 218 that thermally segments the regenerator 112, 212 into different segments 120, 220 so that a reduced amount of heat flows axially along the regenerator 112, 212.

During this time, heat is transferred out of and into the fluid using the regenerator at step 506. This could include, for example, absorbing heat from the fluid into the regenerator 112, 212 as the fluid moves from the warm end to the cold end of the cryocooler. This could also include transferring heat from the regenerator 112, 212 into the fluid as the fluid moves from the cold end to the warm end of the cryocooler. Also, heat is transported substantially laterally through one or more carbon-based anisotropic thermal layers in the regenerator at step 508 while the one or more carbon-based anisotropic thermal layers substantially block heat transport axially through the regenerator at step 510. This could include, for example, carbon nanotubes or graphene in the anisotropic thermal layers 118, 218 transporting heat substantially laterally within the thermal layers 118, 218. The anisotropic thermal layers 118, 218 can substantially block heat transport axially within the regenerators 112, 212.

Via these operations, the cryocooler is used to cool a device or system at step 512. This could include, for example, the cryocooler 100, 200 operating so that the cold end of the cryocooler cools a focal plane array or other device or system where cooling is desired or required. The cryocooler could cool the device or system to any suitably low temperature.

Although FIG. 5 illustrates one example of a method 500 for cooling a structure using a cryocooler having a regenerator that contains one or more carbon-based anisotropic thermal layers, various changes may be made to FIG. 5. For example, while shown as a series of steps, various steps in FIG. 5 could overlap, occur in parallel, or occur any number of times.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a regenerator configured to transfer heat to a fluid and to absorb heat from the fluid as the fluid flows between a warm end and a cold end of a cryocooler;

wherein the regenerator comprises:

multiple anisotropic thermal layers, each of the anisotropic thermal layers comprising a film configured to reduce a flow of heat axially along the regenerator and to spread the absorbed heat radially or laterally in a plane of that anisotropic thermal layer, each of the anisotropic thermal layers comprising at least one allotropic form of carbon, and one or more support layers configured to structurally support at least one of the anisotropic thermal layers.

2. The apparatus of claim 1, wherein each of the anisotropic thermal layers has a higher radial or lateral thermal conductivity and a lower axial thermal conductivity.

3. The apparatus of claim 1, wherein each of the anisotropic thermal layers comprises at least one of: carbon nanotubes and graphene.

4. The apparatus of claim 1, wherein:

the anisotropic thermal layers divide the regenerator into multiple segments; and each of the anisotropic thermal layers are configured to reduce heat transfer between adjacent segments of the regenerator.

5. The apparatus of claim 1, wherein the one or more support layers are configured to impart a higher heat capacity to the at least one anisotropic thermal layer.

6. The apparatus of claim 1, wherein each of the one or more support layers comprises a screen or mesh.

7. A system comprising:

a cryocooler having a warm end and a cold end, the cryocooler comprising:

a compressor configured to move a fluid between the warm end and the cold end of the cryocooler; and a regenerator configured to contact the fluid, the regenerator also configured to transfer heat to the fluid and to absorb heat from the fluid as the fluid flows between the warm end and the cold end of the cryocooler;

wherein the regenerator comprises:

multiple anisotropic thermal layers, each of the anisotropic thermal layers comprising a film configured to reduce a flow of heat axially along the regenerator and to spread the absorbed heat radially or laterally in a plane of that anisotropic thermal layer, each of the anisotropic thermal layers comprising at least one allotropic form of carbon, and one or more support layers configured to structurally support at least one of the anisotropic thermal layers.

8. The system of claim 7, wherein each of the anisotropic thermal layers has a higher radial or lateral thermal conductivity and a lower axial thermal conductivity.

9. The system of claim 7, wherein each of the anisotropic thermal layers comprises at least one of: carbon nanotubes and graphene.

10. The system of claim 7, wherein:

the anisotropic thermal layers divide the regenerator into multiple segments; and each of the anisotropic thermal layers are configured to reduce heat transfer between adjacent segments of the regenerator.

11. The system of claim 7, wherein the one or more support layers are configured to impart a higher heat capacity to the at least one anisotropic thermal layer.

12. The system of claim 7, wherein each of the one or more support layers comprises a screen or mesh.

13. The system of claim 7, wherein the regenerator is positioned around a pulse tube of the cryocooler.

14. The system of claim 7, wherein the regenerator is positioned within one stage of a multi-stage cryocooler.

15. A method comprising:

creating a flow of fluid back and forth between a warm end and a cold end of a cryocooler;

transferring heat to the fluid and absorbing heat from the fluid using a regenerator as the fluid flows between the warm end and the cold end of the cryocooler;

reducing a flow of heat axially along the regenerator using multiple anisotropic thermal layers within the regenerator, each of the anisotropic thermal layers comprising a film spreading the absorbed heat radially or laterally in a plane of that anisotropic thermal layer, each of the anisotropic thermal layers comprising at least one allotropic form of carbon; and structurally supporting at least one of the anisotropic thermal layers using one or more support layers.

16. The method of claim 15, wherein each of the anisotropic thermal layers has a higher radial or lateral thermal conductivity and a lower axial thermal conductivity.

17. The method of claim 15, wherein each of the anisotropic thermal layers comprises at least one of: carbon nanotubes and graphene.

18. The method of claim 15, wherein each of the anisotropic thermal layers has a controllable porosity to reduce occurrence of a pressure drop across the regenerator.

19. The method of claim 15, wherein:

the anisotropic thermal layers divide the regenerator into multiple segments; and each of the anisotropic thermal layers are configured to reduce heat transfer between adjacent segments of the regenerator.

20. The method of claim 15, further comprising:

using the one or more support layers to impart a higher heat capacity to the at least one anisotropic thermal layer.

* * * * *